US010352588B2

(12) United States Patent
Broker

(10) Patent No.: US 10,352,588 B2
(45) Date of Patent: Jul. 16, 2019

(54) SYSTEMS AND METHODS FOR CONTROLLING GAS POWERED APPLIANCES

(71) Applicant: Emerson Electric Co., St. Louis, MO (US)

(72) Inventor: John Broker, Warrenton, MO (US)

(73) Assignee: Emerson Electric Co., St. Louis, MO (US)

( * ) Notice: Subject to any disclaimer, the term of this patent is extended or adjusted under 35 U.S.C. 154(b) by 302 days.

(21) Appl. No.: 15/138,745

(22) Filed: Apr. 26, 2016

(65) Prior Publication Data

US 2017/0307256 A1 Oct. 26, 2017

(51) Int. Cl.
*F24H 9/20* (2006.01)
*F24H 3/00* (2006.01)

(52) U.S. Cl.
CPC ..... *F24H 9/2071* (2013.01); *F24H 3/006* (2013.01); *F24H 9/2085* (2013.01)

(58) Field of Classification Search
None
See application file for complete search history.

(56) References Cited

U.S. PATENT DOCUMENTS

| | | | | |
|---|---|---|---|---|
| 3,512,909 | A | 5/1970 | Perkings | |
| 3,609,072 | A | 9/1971 | Willson | |
| 4,082,493 | A | 4/1978 | Dahlgren | |
| 4,405,299 | A | 9/1983 | Serber | |
| 5,076,780 | A | 12/1991 | Erdman | |
| 5,277,575 | A * | 1/1994 | Newberry | F23N 5/203 431/24 |
| 6,803,544 | B1 * | 10/2004 | Zikes | F23Q 7/24 219/263 |
| 2014/0134548 | A1 | 5/2014 | Broker et al. | |

* cited by examiner

*Primary Examiner* — Steven B McAllister
*Assistant Examiner* — John E Bargero
(74) *Attorney, Agent, or Firm* — Armstrong Teasdale LLP

(57) ABSTRACT

A control system for controlling a gas powered appliance includes a hot surface igniter, an igniter relay, and an integrity detection circuit. The integrity detection circuit is configured to be coupled to a power source, the igniter relay, and the hot surface igniter to produce an output indicative of the integrity of the hot surface igniter and the igniter relay. The integrity detection circuit is configured to output a first voltage when the igniter relay is closed and output a second voltage different from the first voltage when the hot surface igniter is in a non-short circuit failure condition.

20 Claims, 3 Drawing Sheets

SYSTEMS AND METHODS FOR CONTROLLING GAS POWERED APPLIANCES

FIELD

The field of the disclosure relates generally to gas powered appliances, and more particularly, to systems and methods for testing the integrity of a hot surface igniter and an igniter relay in a gas powered furnace or water heater.

BACKGROUND

Gas powered appliances, such as gas powered furnaces, often include a hot surface igniter selectively connectable to a power source through an ignition relay. Failure of the hot surface igniter or the igniter relay can cause a failure of the gas powered appliance. It may be difficult to determine which of the hot surface igniter and the igniter relay has failed, and operators may choose to replace both when only one component has failed. This unnecessarily adds to the cost of operating the gas powered appliance. While there are known systems to detect failures such as current sensors, these systems are relatively expensive. A more cost effective and reliable system for detecting failure of the hot surface igniter relay or the igniter relay is needed.

This Background section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

SUMMARY

According to one aspect of this disclosure, a control system for controlling a gas powered appliance includes a hot surface igniter, an igniter relay, and an integrity detection circuit. The integrity detection circuit is configured to be coupled to a power source, the igniter relay, and the hot surface igniter to produce an output indicative of the integrity of the hot surface igniter and the igniter relay. The integrity detection circuit is configured to output a first voltage when the igniter relay is closed and output a second voltage different from the first voltage when the hot surface igniter is in a non-short circuit failure condition.

Another aspect is a gas powered furnace for a heating ventilation and air conditioning (HVAC) system. The gas powered furnace includes an inducer relay, an igniter relay, a first resistance, a second resistance, a third resistance, a hot surface igniter, and a node between the first and second resistances. The inducer relay has a first terminal to be connected to a power source and has a second terminal. The igniter relay has a first terminal coupled to the inducer relay second terminal, and has a second terminal. The first resistance is coupled to the inducer relay second terminal. The second resistance is coupled in series with the first resistance. The third resistance is coupled to the second resistance and the igniter relay second terminal. The hot surface igniter is coupled in parallel with the third resistance, such that when the inducer relay is connected to the power source and closed the measurement node is at a first voltage if the igniter relay has failed and at a second voltage different from the first voltage if the hot surface igniter has failed in a non-short circuit condition.

Yet another aspect of this disclosure is a method of testing the integrity of a hot surface igniter and an igniter relay in a gas powered furnace. The gas powered furnace includes a control system including the hot surface igniter, the igniter relay, an induction relay, an integrity detection circuit coupled to the igniter relay and the hot surface igniter to produce an output indicative of the integrity of the hot surface igniter and the igniter relay. The method is performed by a controller operable to control the gas powered furnace. The method includes closing the induction relay to connect the power source to the igniter relay, the integrity detection circuit, and the hot surface igniter, holding the igniter relay in an open position to prevent the power source from being connected to the hot surface igniter through the igniter relay, detecting the output of the integrity detection circuit, determining, by the controller, that the igniter relay has failed in a closed position if the output of the integrity detection circuit is a first voltage, and determining, by the controller, that the hot surface igniter has failed in a non-short circuit condition if the output of the integrity detection circuit is a second voltage different from the first voltage.

Various refinements exist of the features noted in relation to the above-mentioned aspects. Further features may also be incorporated in the above-mentioned aspects as well. These refinements and additional features may exist individually or in any combination. For instance, various features discussed below in relation to any of the illustrated embodiments may be incorporated into any of the above-described aspects, alone or in any combination.

BRIEF DESCRIPTION OF THE DRAWINGS

Like reference symbols in the various drawings indicate like elements.

DETAILED DESCRIPTION

The embodiments described herein generally relate to gas powered appliances. More specifically, embodiments described herein relate to methods and systems for controlling operation of a gas powered furnace or a gas powered water heater, including testing the integrity of a hot surface igniter and an igniter relay.

Figure 1:
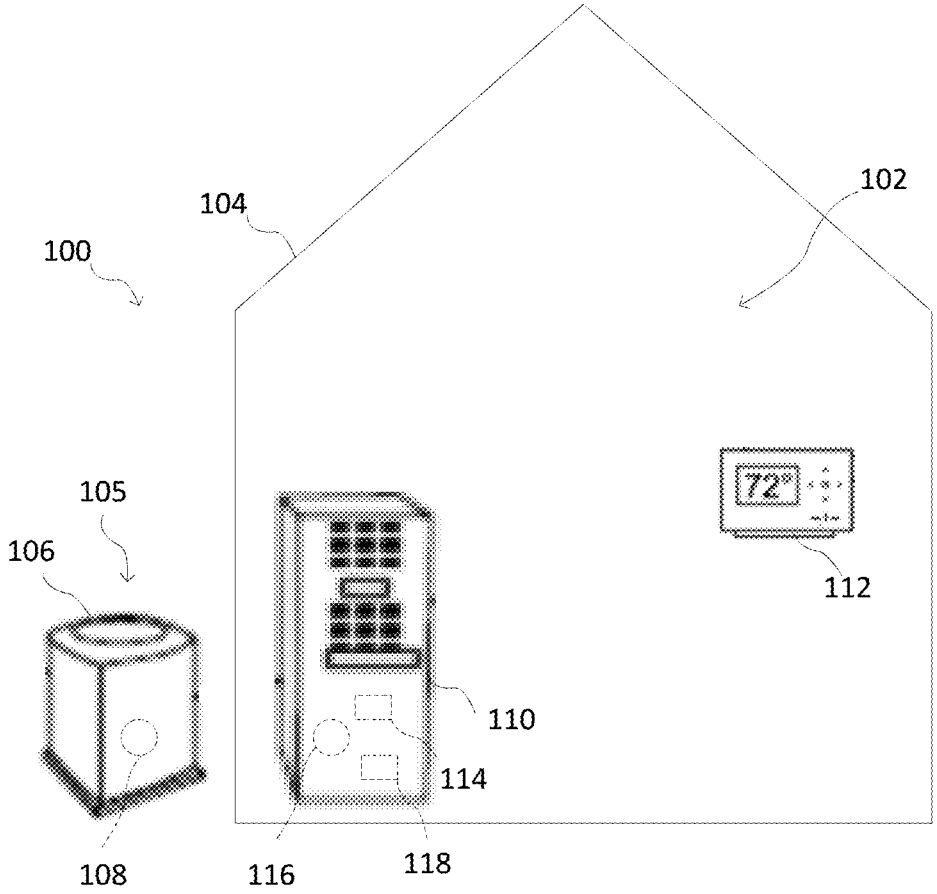
FIG. 1 is an illustration of an example climate control system.

An example of a climate control system of this disclosure is indicated generally in FIG. 1 by reference number 100. In this example, the climate control system 100 is a heating ventilation and air conditioning (HVAC) system for controlling the climate of the interior 102 of enclosure 104. An air conditioner 105 includes a condenser unit 106 having a compressor 108. The system 100 also includes a gas-fired furnace 110. Climate control system embodiments also are possible that include, e.g., a heat pump, a humidifier, a dehumidifier, an auxiliary heating system having a gas-fired furnace, and the like.

A thermostat 112 is capable of sensing temperature and responsively initiating operation of the air conditioner 105 or furnace 110 when the sensed temperature is more than a predetermined amount above or below a set point temperature of the thermostat 112. When the thermostat 112 signals a request for heating, a furnace controller 114 controls the activation of the furnace 110, which includes activation of an inducer 116 and an igniter 118 to provide for heating operation. The igniter is a resistive hot surface igniter. In other embodiments, the igniter is any other igniter suitable for the system described herein. In various aspects of the present disclosure, the furnace controller 114 is configured to test the integrity of the furnace 110 as further described below.

Figure 2:
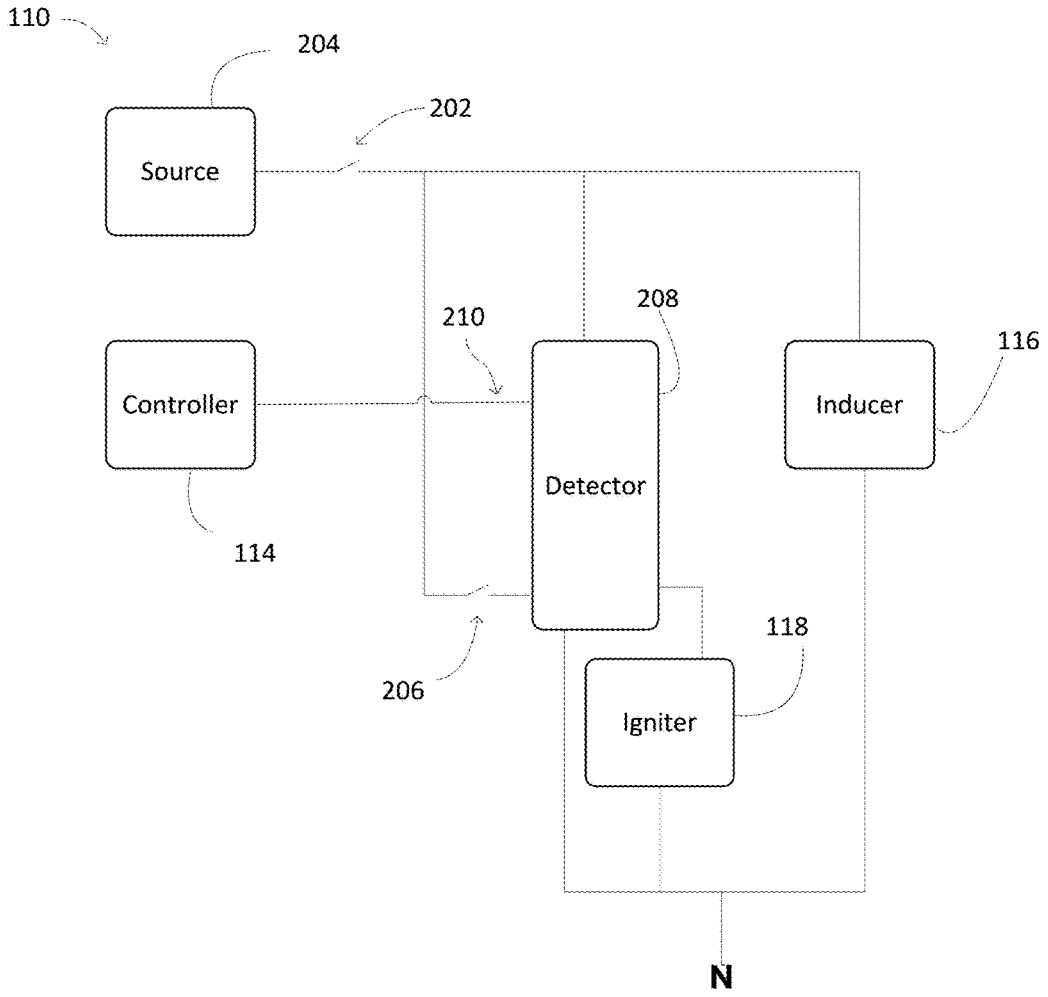
FIG. 2 is a block diagram of a portion of a control system for use in the climate control system shown in FIG. 1.

FIG. 2 is a block diagram of a portion of the furnace 110 for use in the climate control system shown FIG. 1. The illustrated portion of the furnace 110 is operable for activating the furnace 110 and checking the integrity of the ignition system.

When furnace controller 114 activates the furnace 110, the furnace controller 114 closes an inducer relay 202 to couple a power source 204 to the inducer 116, an igniter relay 206, and an integrity detection circuit 208. In the example embodiment, the power source is a 120 volt (nominal) alternating current (AC) power source. Alternatively, the power source 204 is any other power source suitable for powering the inducer 116 and the igniter 118. When the furnace controller 114 couples the source 204 to the inducer 116, the inducer begins operating. Initially, the furnace controller 114 does not close the igniter relay 206, and the igniter 118 is not activated. Before activating the igniter 118, the integrity of the igniter relay 206 and the igniter are tested by the furnace controller 114 using the integrity detection circuit 208.

When connected to the power source 204, the integrity detection circuit 208 provides an output at 210 that indicates the integrity of the igniter relay 206 and the igniter 118 (sometimes collectively referred to as the ignition system). More specifically, the integrity detection circuit 208 provides a first output (also refereed to sometimes as a signal) if the igniter relay 206 is closed, which it should not be at this time in the sequence of furnace activation. An unexpectedly closed igniter relay 206 typically indicates that the igniter relay 206 has failed in a closed position, which is sometimes referred to as being "welded closed". The integrity detection circuit 208 outputs a second output different from the first output if the igniter 118 has experienced a non-short circuit failure. Non-short circuit failures includes failures resulting in an open circuit igniter 118 and failures resulting in a relatively high resistance (e.g., a resistance of hundreds or thousands of kilohms) with respect to the relatively low resistance of a cold igniter 118 (e.g., less than 100 ohms). In the example embodiment, the integrity circuit 208 outputs the second output is the igniter 118 has experienced a non-short circuit failure and the igniter relay 206 is not closed. In other embodiments, the second output is produced when the igniter 118 is an open or high resistance circuit or without regard to the status of the igniter relay 206. If the igniter relay 206 and the igniter 118 are operating properly (e.g., the igniter relay 206 is open and the igniter 118 is not an open circuit), the integrity detection circuit 208 provides a third output different than the first and second output.

The furnace controller 114 receives the output from the integrity detection circuit 208 and uses the output to determine the integrity of the ignition system. Specifically, the controller 114 determines that the ignition relay 206 has failed if it receives the first output, determines that the igniter 118 has failed if it receives the second output, and determines that the igniter 118 and the ignition relay 206 are functioning properly if it receives the third output. The controller 114 may store the determination in a memory device (not shown), generate a human cognizable alert signal (such as an audible or visual alert on a component of the furnace, on a remote computing device, on a telephone, or the like) corresponding to the determination, transmit the determination to another controller or computing device (not shown), or take any other suitable action or combination of actions.

If the furnace controller 114 receives the third output and determines that the ignition system is operating properly, the furnace controller proceeds to close the ignition relay 206 to activate the igniter. In due course, the furnace controller turns on the gas supply to be ignited by the igniter 118 to provide heating. If the furnace controller 114 receives the first output and determines that the ignition relay 206 has failed in a closed position, the furnace controller 114 continues to operate as normal, but may generate an alert and/or store the determination as described above. Alternatively, the furnace controller 114 may prevent continued operation of the furnace 110 after determining that the ignition relay 206 has failed. If the furnace controller 114 receives the second output and determines that the igniter 118 has failed in a non-short circuit condition, the furnace controller 114 prevents further operation of the furnace 110.

Figure 3:
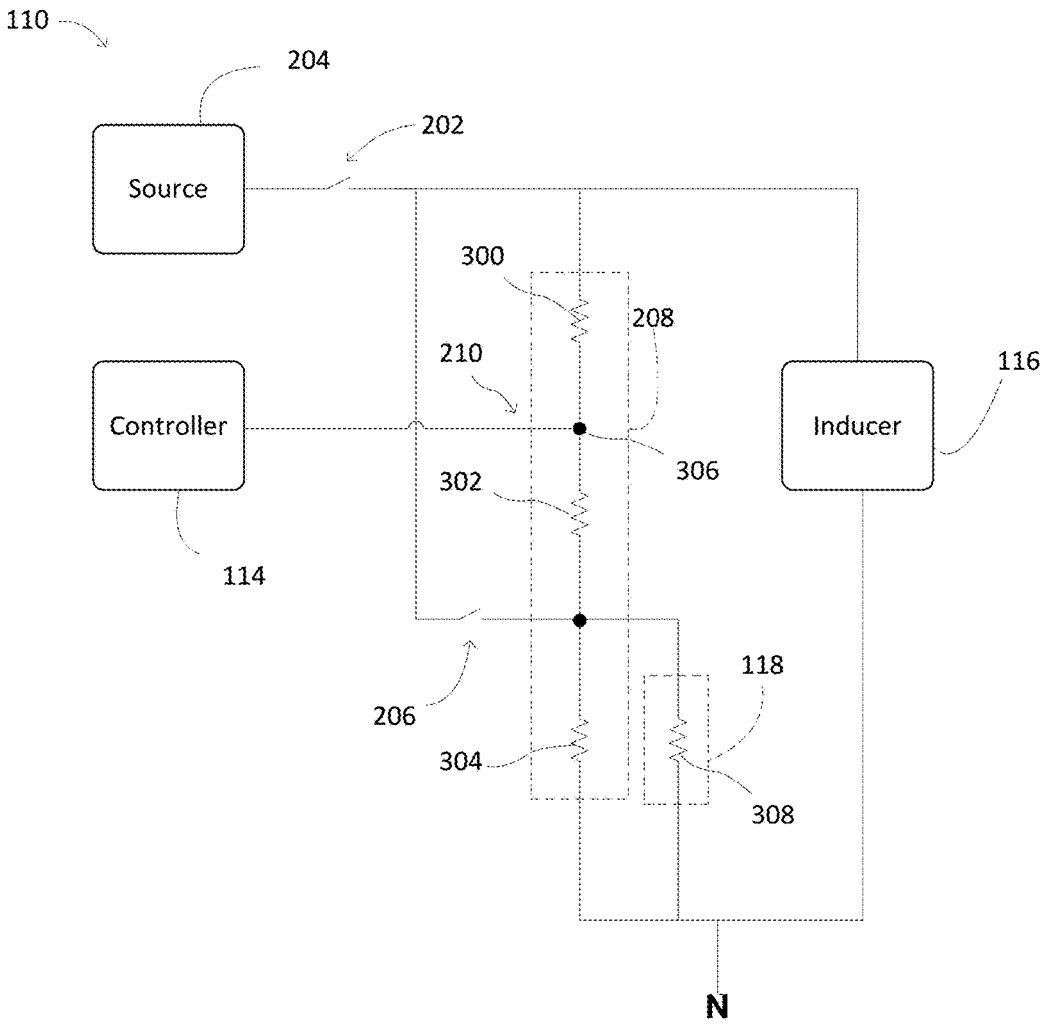
FIG. 3 is a schematic block diagram of an embodiment of the control system shown in FIG. 2.

FIG. 3 is a schematic block diagram of an embodiment of the portion of the furnace 110 shown in FIG. 2. In this embodiment, the integrity detection circuit 208 includes a first resistance 300, a second resistance 302, and a third resistance 304 arranged to form a voltage divider circuit, with the third resistance 304 connected in parallel with the igniter 118. The output of the integrity detection circuit 208 is the voltage at node 306 between the first resistance 300 and the second resistance 302. Although each is illustrated as a single resistor, resistances 300, 302, and 304 each represent an equivalent resistance that may be formed by any number of series and/or parallel connected resistors. In the example embodiment, the first resistance 300 has a resistance of about 100 kilohms (kΩ), the second resistance 302 has a resistance of about 50 kΩ, and the third resistance 304 has a resistance of about 150 kΩ. Other embodiments include resistances in any other suitable combination in similar or different proportions that provide sufficient separation between the three signals generated by the integrity detection circuit to account for variation in a 120 VAC line, which can vary between about 100 VAC to 130 VAC. More separation is better in general, but as the values of the resistances get very high, the current through the resistances gets low, which makes the signal higher impedance and this can cause more sensitivity to moisture and noise and contamination. Conversely, if the values are too low, it takes more power and a larger part with greater cost may be needed to handle the higher power.

In operation, if the ignition relay 206 has failed and is welded closed (as noted above when the relay is unexpectedly closed), when the inducer relay 202 is closed at activation of the furnace 110, the entire voltage of the source 204 will appear at node 306. Thus, the integrity detection circuit 208 will output the voltage of the power source 204 as the first output. If the ignition relay 206 is operating properly (i.e., it is open), but the igniter 118 has failed open, current will flow through all three resistances 300, 302, and 304. As a result, the second output of the voltage at node 306 will be the voltage across the series connection of the second resistance 302 and the third resistance 304. In the example embodiment with the resistances described above, two-thirds of the voltage of the power source 204 will appear at node 306 and be output as the second output of the integrity detection circuit 208. If the ignition relay 206 is operating properly (i.e., it is open), but the igniter 118 has failed with a high resistance (but not completely open), current will flow through the series connection of resistances 300, 302, and the parallel connected resistance 304 and igniter 118. If the resistance of the failed igniter 118 is high enough relative to the resistance 304, the equivalent resistance of the parallel connected resistance 304 and igniter 118 will approach the value of the resistance 304 and the second output will be substantially the same as in the case of a fully open igniter 118. If the resistance of the failed igniter 118 is closer to the resistance 304, the equivalent resistance of the parallel connected resistance 304 and igniter 118 will be less than the value of the resistance 300 and the second output will not be the same as in the case of a fully open igniter. However, with proper selection of resistance values for the resistances 300, 302, and 304 the second output will still be distinguishable from the first and third outputs. Moreover, in some embodiments, the value of resistances 300, 302, and 304 are selected such that the resistance of a non-short circuit failed igniter 118 will always be high relative to the resistance value of the third resistance 304 (e.g., a resistance 304 that is ten times smaller than an expected minimum resistance of a non-short circuit failed igniter 118). If the ignition relay 206 and the igniter 118 are both functioning properly, the third resistance 304 and an igniter resistance 308 of the igniter 118 are connected in parallel. The igniter resistance 308 is a positive temperature coefficient (PTC) resistance that increases with temperature. At startup, the igniter resistance 308 will be a very low resistance, relative to the third resistance 304. Accordingly, the parallel connection of the very low igniter resistance 308 and the relatively high third resistance 304 will produce an equivalent resistance that is close to the low value of igniter resistance 308. The series connection of the second resistance 302 and the parallel connected third resistance 304 and igniter resistance 308 will have an equivalent resistance close the value of the second resistance. In the example embodiment with the resistance values described above, the resulting voltage at the node 306 is about one third of the value of the power source voltage. Thus, when the example embodiment is used with a power source 204 voltage of about 120 volts, the first output of the integrity detection circuit 208 is about 120 volts, the second output of the integrity detection circuit 208 is about 80 volts, and the third output of the integrity detection circuit 208 is about 40 volts.

The furnace controller 114 may include and/or be embodied in a computing device. The computing device may include, a general purpose central processing unit (CPU), a microcontroller, a reduced instruction set computer (RISC) processor, an application specific integrated circuit (ASIC), a programmable logic circuit (PLC), and/or any other circuit or processor capable of executing the functions described herein. The methods described herein may be encoded as executable instructions embodied in a computer-readable medium including, without limitation, a storage device and/or a memory device. Such instructions, when executed by a processor, cause the processor to perform at least a portion of the methods described herein. The memory device can include, but is not limited to, random access memory (RAM) such as dynamic RAM (DRAM) or static RAM (SRAM), read-only memory (ROM), erasable programmable read-only memory (EPROM), electrically erasable programmable read-only memory (EEPROM), and non-volatile RAM (NVRAM). The above memory types are example only, and are thus not limiting as to the types of memory usable for storage.

The furnace controller 114 may include one or more communication interfaces allowing the furnace controller 114 to communicate with remote devices and systems, such as of the integrity detection circuit 208, sensors, valve control systems, safety systems, remote computing devices, and the like. The communication interfaces may be wired or wireless communications interfaces that permit the computing device to communicate with the remote devices and systems directly or via a network. Wireless communication interfaces may include a radio frequency (RF) transceiver, a Bluetooth® adapter, a Wi-Fi transceiver, a ZigBee® transceiver, a near field communication (NFC) transceiver, an infrared (IR) transceiver, and/or any other device and communication protocol for wireless communication. (Bluetooth is a registered trademark of Bluetooth Special Interest Group of Kirkland, Wash.; ZigBee is a registered trademark of the ZigBee Alliance of San Ramon, Calif.) Wired communication interfaces may use any suitable wired communication protocol for direct communication including, without limitation, USB, RS232, I2C, SPI, analog, and proprietary I/O protocols. Moreover, in some embodiments, the wired communication interfaces include a wired network adapter allowing the computing device to be coupled to a network, such as the Internet, a local area network (LAN), a wide area network (WAN), a mesh network, and/or any other network to communicate with remote devices and systems via the network.

Although described herein with reference to an HVAC system and a gas-fired furnace, it should be understood the methods and systems described herein are suitable for use in any gas-fired appliance using a hot surface igniter including, for example, gas powered boilers, pool heaters, water heaters, clothes dryers, ovens, and the like. Moreover, although described with respect to a particular configuration, the systems and methods described herein can be used with systems with different configuration. For example, some gas appliances may use an extra set of contacts for driving the gas valve using two inductor relays or two gas valve relays. The system and methods described herein can be used in such a system to provide better diagnostics and identify a failed igniter.

Embodiments of the methods and systems described herein achieve superior results compared to prior methods and systems. The example integrity detection circuits monitor the integrity of the ignition relay and the igniter in a gas powered appliance and outputs distinct indications of the status of the components of the ignition system without use of any current sensors. Each output of the example integrity detection circuit indicates one of the ignition relay has failed closed, the igniter has failed open, and the igniter and the ignition relay are operational. These distinct indications are achieved without use of expensive current sensors, thereby reducing cost, complexity and fragility of the systems incorporating the integrity detection circuits described herein. Moreover, the example circuits provide a safety advantage by identifying the lack of a functioning igniter. Additionally, when a failure is detected, noise and power usage can be reduced by turning off the unneeded inducer.

Example embodiments of systems and methods for controlling a water heater are described above in detail. The system is not limited to the specific embodiments described herein, but rather, components of the system may be used independently and separately from other components described herein. For example, the controller and processor described herein may also be used in combination with other systems and methods, and are not limited to practice with only the system as described herein.

When introducing elements of the present disclosure or the embodiment(s) thereof, the articles "a", "an", "the" and "said" are intended to mean that there are one or more of the elements. The terms "comprising," "including," "containing" and "having" are intended to be inclusive and mean that there may be additional elements other than the listed elements. The use of terms indicating a particular orientation (e.g., "top", "bottom", "side", etc.) is for convenience of description and does not require any particular orientation of the item described.

As various changes could be made in the above constructions and methods without departing from the scope of the disclosure, it is intended that all matter contained in the above description and shown in the accompanying drawing (s) shall be interpreted as illustrative and not in a limiting sense.

What is claimed is:

1. A control system for controlling a gas powered appliance, the control system comprising:

a hot surface igniter;

an igniter relay for supplying power to the hot surface igniter;

an integrity detection circuit configured to be coupled to a power source, the igniter relay, and the hot surface igniter to produce an output indicative of the integrity of the hot surface igniter and the igniter relay, independent of a current measurement, the integrity detection circuit configured to:

output a first voltage, indicative of the igniter relay having failed in the closed position; and output a second voltage different from the first voltage when the hot surface igniter is in a non-short circuit failure condition.

2. The control system of claim 1, wherein the integrity detection circuit is further configured to output a third voltage different from the first voltage and the second voltage when the hot surface igniter and the igniter relay are functioning properly.

3. The control system of claim 2, further comprising an additional relay to selectively connect the integrity detection circuit, the igniter relay, and the hot surface igniter to the power source.

4. The control system of claim 3, wherein the integrity detection circuit is configured to output the first voltage, the second voltage, or the third voltage when the additional relay connects the integrity detection circuit, the igniter relay, and the hot surface igniter to the power source.

5. The control system of claim 4, further comprising an inducer coupled to the additional relay, wherein the additional relay is an inducer relay to selectively connect the inducer to the power source.

6. The control system of claim 2, wherein the integrity detection circuit is free of a current sensor.

7. The control system of claim 2, wherein the integrity detection circuit includes a plurality of resistors having a measurement node between two resistors of the plurality of resistors.

8. The control system of claim 7, wherein the plurality of resistors are arranged to produce the first voltage at the measurement node when the igniter relay is closed, to produce the second volt at the measurement node when the hot surface igniter is an open circuit, and to produce the third voltage at the measurement node when the hot surface igniter and the igniter relay are functioning properly.

9. The control system of claim 2, further comprising a controller operable to control the gas powered appliance, the controller coupled to the integrity detection circuit to receive the output indicative of the integrity of the hot surface igniter and the igniter relay.

10. The control system of claim 2, wherein the gas powered appliance comprises a gas furnace of a heating ventilation and air conditioning system.

11. A gas powered furnace for a heating ventilation and air conditioning (HVAC) system, the gas powered furnace comprising:

an inducer relay having a first terminal to be connected to a power source, and having a second terminal;

an igniter relay having a first terminal coupled to the inducer relay second terminal, and having a second terminal;

a first resistance coupled to the inducer relay second terminal;

a second resistance coupled in series with the first resistance;

a node between the first and second resistance;

a third resistance coupled to the second resistance and the igniter relay second terminal; and a hot surface igniter powered from the igniter relay and coupled in parallel with the third resistance, such that when the inducer relay is connected to the power source and closed the measurement node is at a first voltage if the igniter relay has failed and at a second voltage different from the first voltage if the hot surface igniter has failed in a non-short circuit condition.

12. The gas powered furnace of claim 11 wherein when the inducer relay is connected to the power source and closed the measurement node is at a third voltage different from the first voltage and the second voltage if the igniter relay and the hot surface igniter are functioning properly.

13. The gas powered furnace of claim 11 wherein the first resistance comprises a plurality of parallel connected first resistors, and the second resistance comprises a plurality of parallel connected second resistors.

14. The gas powered furnace of claim 12 wherein the first resistance is about one hundred kilohms, the second resistance is about fifty kilohms, and the third resistance is about one hundred and fifty kilohms.

15. The gas powered furnace of claim 12, further comprising a controller operable to control the gas powered furnace, the controller coupled to measurement node to determine the integrity of the hot surface igniter and the igniter relay based on the voltage of the measurement node and independent of a current measurement.

16. A method of testing the integrity of a hot surface igniter and an igniter relay that supplies power to the hot surface igniter in a gas powered furnace, the gas powered furnace comprising a control system including the hot surface igniter, the igniter relay, an induction relay, an integrity detection circuit coupled to the igniter relay and the hot surface igniter to produce an output indicative of the integrity of the hot surface igniter and the igniter relay independent of a current measurement, the method performed by a controller operable to control the gas powered furnace, the method comprising:

closing the induction relay to connect the power source to the igniter relay, the integrity detection circuit, and the hot surface igniter;

holding the igniter relay in an open position to prevent the power source from being connected to the hot surface igniter through the igniter relay;

detecting the output of the integrity detection circuit;

determining, by the controller, that the igniter relay has failed in a closed position if the output of the integrity detection circuit is a first voltage; and determining, by the controller, that the hot surface igniter has failed in a non-short circuit condition if the output of the integrity detection circuit is a second voltage different from the first voltage.

17. The method of claim 16, further comprising determining, by the controller, that the hot surface igniter and the igniter relay are functioning properly if the output voltage is a third voltage different from the first voltage and the second voltage.

18. The method of claim 16, further comprising:

storing, in a memory device, an indication that the igniter relay has failed in a closed position if the output of the integrity detection circuit is a first voltage; and storing, in a memory device, an indication that the hot surface igniter has failed in a non-short circuit condition if the output of the integrity detection circuit is a second voltage different from the first voltage.

19. The method of claim 16, further comprising generating at least one alert if the output of the integrity detection circuit is the first voltage or the second voltage.

20. The method of claim 19, wherein generating the at least one alert comprises generating at least one human cognizable alert including at least one of displaying a visual alert and generating an audible alert.

* * * * *